US010465669B2

(12) United States Patent
Corey

(10) Patent No.: US 10,465,669 B2
(45) **Date of Patent: *Nov. 5, 2019**

(54) SPIN PUMP WITH SPUN-EPICYCLIC GEOMETRY HAVING PISTON BORES CAPPED WITH CAPS INCLUDING DUCTS OR VALVES WITHIN THE ROTOR

(71) Applicant: Chart Inc., Ball Ground, GA (US)

(72) Inventor: John Corey, Ball Ground, GA (US)

(73) Assignee: Chart Inc., Ball Ground, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/714,875

(22) Filed: Sep. 25, 2017

(65) Prior Publication Data

US 2018/0073493 A1 Mar. 15, 2018

Related U.S. Application Data

(63) Continuation of application No. 14/510,904, filed on Oct. 9, 2014, now Pat. No. 9,771,931.

(60) Provisional application No. 61/888,893, filed on Oct. 9, 2013.

(51) Int. Cl.

| | |
|---|---|
| ***F04B 27/06*** | (2006.01) |
| ***F04B 25/04*** | (2006.01) |
| ***F04B 41/06*** | (2006.01) |
| ***F04B 39/00*** | (2006.01) |
| ***F04B 1/113*** | (2006.01) |

(52) U.S. Cl.

CPC ..... *F04B 27/0612* (2013.01); *F04B 1/1136* (2013.01); *F04B 25/04* (2013.01); *F04B 39/0094* (2013.01); *F04B 41/06* (2013.01)

(58) Field of Classification Search

CPC ..... F04B 25/04; F04B 39/0094; F04B 41/06; F04B 1/1133; F04B 1/1136; F04B 53/162; F04B 49/128; Y10T 74/18024; Y10T 403/70; Y10T 403/64; Y10T 403/69

USPC ..... 91/493; 418/54; 123/54.2; 417/460, 417/469, 464

See application file for complete search history.

(56) References Cited

U.S. PATENT DOCUMENTS

| | | | | | |
|---|---|---|---|---|---|
| 753,390 | A * | 3/1904 | Hamann | F01B 13/02 | 417/462 |
| 1,528,075 | A * | 3/1925 | Richer | F04C 2/344 | 418/108 |
| 1,853,394 | A * | 4/1932 | Appel | F04B 1/1136 | 417/462 |
| 1,910,876 | A * | 5/1933 | Appel | F04B 1/1136 | 417/462 |
| 1,918,408 | A * | 7/1933 | Lakin-Smith | F04B 1/1136 | 417/462 |
| 2,045,330 | A * | 6/1936 | MacMillin | F04B 1/0426 | 91/493 |
| 2,121,120 | A * | 6/1938 | De Lancey | G01F 3/18 | 123/48 B |
| 2,246,868 | A * | 6/1941 | Trask | F04B 27/053 | 417/372 |

(Continued)

*Primary Examiner* — Devon C Kramer
*Assistant Examiner* — Benjamin Doyle
(74) *Attorney, Agent, or Firm* — Cook Alex Ltd.; R. Blake Johnston

(57) ABSTRACT

The subject matter described herein relates to a spin pump that includes a combination of a compressor and a vacuum pump on respective pistons extending from a common crankshaft in a rotating housing. Related methods, apparatuses, systems, techniques and articles are also described.

17 Claims, 9 Drawing Sheets

(56) References Cited

U.S. PATENT DOCUMENTS 2,337,427 A * 12/1943 Thompson ..... F04B 1/0421 91/493
2,462,725 A * 2/1949 Cuny ..... F04B 1/0426 285/910
2,661,699 A * 12/1953 Smith ..... F01B 1/0624 74/25
2,683,422 A * 7/1954 Richards, Jr. ..... F01B 13/068 123/44 R
2,684,038 A * 7/1954 Johnson ..... F04B 1/1133 91/493
2,831,438 A * 4/1958 Guinard ..... F04B 1/1133 91/492
2,932,255 A * 4/1960 Neukirch ..... F01B 1/0689 417/429
3,056,356 A * 10/1962 Piper ..... F04B 1/1136 417/462
3,093,079 A * 6/1963 Graham ..... F02M 55/00 123/455
3,175,758 A * 3/1965 Dirk ..... F04B 27/005 251/368
3,239,589 A * 3/1966 White ..... B29C 45/14754 264/242
3,521,533 A * 7/1970 Van Avermaete ..... F01B 13/02 123/44 C
3,665,811 A 5/1972 Van Avermaete
3,680,444 A * 8/1972 Casey ..... F01B 1/0668 91/493
3,710,691 A * 1/1973 Sullivan ..... F01B 13/06 91/496
3,799,035 A * 3/1974 Lamm ..... F02B 57/08 123/44 D
3,865,093 A * 2/1975 Ferragut Rodriguez ..... F02B 57/08 123/44 D
3,921,602 A * 11/1975 Froumajou ..... F02B 57/04 123/44 D
3,961,868 A * 6/1976 Droege, Sr. ..... F04B 35/04 417/550
3,977,303 A * 8/1976 Baker ..... F01B 1/0644 123/190.8
4,030,458 A * 6/1977 Lamm ..... F01B 13/02 123/44 D
4,057,367 A * 11/1977 Moe ..... F04B 27/06 417/273
4,225,295 A * 9/1980 Shimizu ..... F01C 19/08 418/142
4,339,988 A * 7/1982 Steele ..... F01B 1/062 91/493
4,503,754 A * 3/1985 Irwin ..... F01B 13/068 91/488
4,730,545 A * 3/1988 Eickmann ..... F01B 13/04 417/515
5,056,640 A * 10/1991 Yamamoto ..... B60K 17/3505 180/248
5,375,564 A * 12/1994 Gail ..... F01B 13/068 123/44 C
5,681,156 A * 10/1997 Rapp ..... F01C 1/06 418/122
6,148,775 A * 11/2000 Farrington ..... F01B 9/026 123/310
6,206,661 B1 * 3/2001 Iida ..... F04C 18/10 417/462
8,240,147 B2 8/2012 Taba
9,771,931 B2 * 9/2017 Corey ..... F04B 27/0612
2002/0056374 A1 * 5/2002 Keefer ..... B01D 53/047 96/125
2003/0188838 A1 * 10/2003 Yancey ..... C04B 18/241 162/9
2005/0072298 A1 * 4/2005 Deane ..... B01D 53/0415 95/96
2006/0233653 A1 * 10/2006 Trapalis ..... F01C 1/22 418/54
2007/0137487 A1 * 6/2007 Whitley ..... B01D 53/0415 96/121
2009/0087330 A1 * 4/2009 Hunt ..... F03C 1/013 418/1
2010/0192565 A1 * 8/2010 Taba ..... F01B 13/068 60/508
2011/0247620 A1 * 10/2011 Armstrong ..... B01D 53/047 128/204.23
2012/0192864 A1 8/2012 Galbraith et al.
2015/0051438 A1 * 2/2015 Taskin ..... A61M 1/1017 600/16
2015/0098841 A1 * 4/2015 Corey ..... F04B 39/0094 417/53
2018/0073493 A1 * 3/2018 Corey ..... F04B 27/0612

* cited by examiner

SPUN-EPICYCLIC PUMP-COMPRESSOR

SPIN PUMP WITH SPUN-EPICYCLIC GEOMETRY HAVING PISTON BORES CAPPED WITH CAPS INCLUDING DUCTS OR VALVES WITHIN THE ROTOR

REFERENCE TO PRIORITY DOCUMENTS

This application is a Continuation of U.S. application Ser. No. 14/510,904, now U.S. Pat. No. 9,771,931 entitled "SPIN PUMP WITH SPUN-EPICYCLIC GEOMETRY" and filed Oct. 9, 2014 and claims priority to U.S. Provisional Application Ser. No. 61/888,893 entitled "SPIN PUMP WITH SPUN-EPICYCLIC GEOMETRY" and filed Oct. 9, 2013. The disclosure of which is hereby incorporated by reference in its entirety.

BACKGROUND

There is a need for inexpensive, compact, high-efficiency oxygen concentrators comprised of compressors and vacuum pumps to drive the pressure-swing and/or vacuum/pressure-swing absorption cycles that separate oxygen from ambient air, such as for therapeutic use in patients with chronic obstructive pulmonary disease (COPD). Such oxygen concentrators typically come in stationary, transportable, and portable varieties. Patients generally prefer more and more the smaller, transportable and portable devices when the patients are still ambulatory. These smaller units have the most severe demands for compactness and weight, plus efficiency (as that drives the duration of the portable battery power source). Vibration can also be a problem when carrying or wearing a portable concentrator.

Stationary concentrators are more cost-driven designs and use a pressure-swing adsorbent (PSA) cycle in which all air pumping in the absorbent beds is done at or above ambient pressure, enabling the use of inexpensive compressors to move the air. In portables however, it is preferred to use vacuum-pressure adsorbent swing (VPSA) cycles, in which the lower-pressure portions of the cycle are sub-atmospheric, because the known absorbents can deliver more oxygen per unit mass of absorber material when the pressures are at such 'vacuum' levels. Nonetheless, the need for these pumps (compressors or compressor-vacuum combinations) must also provide breathable quality gas, which can require that they be non-lubricated devices (i.e., do not use oils for lubrication). To date, all such concentrators have been low-stroke reciprocating devices driven with conventional motors.

There is a long-held need for compact, low-vibration, efficient pressure-vacuum combination pumps and compressors that operate without oils and cost no more than conventional reciprocating types.

Existing patents disclose basic kinematics that resemble some elements of the kinematics arrangements described herein. For example, U.S. Pat. No. 2,831,438 to Guinard describes a rotary piston pump having crossed-piston geometry with two sets of cross pistons riding on sliding "sole plates. (a scotch-yoke variant). Moreover, the Guinard system has a crankshaft that is directly connected to a rotor housing. U.S. Pat. No. 2,683,422 to Richards describes a rotary engine or pump having a similar kinematic geometry to the present disclosure, that is epicyclic motion, with a crankshaft rotating at twice the speed of the cylinders to give relative reciprocation between pistons and cylinders, but Richards drives the cylinders, requiring a gear to impart the required motion to the crank (itself a complex hollow construction over a stationary eccentric), and with separately attached cylinders at each piston face, which makes for a cumbersome construction that is difficult to align adequately (and hence requires gears for synchronization). Richards further leaves to the imagination the actual fluid connections required to function. DeLancey U.S. Pat. No. 2,121,120 is a crossed-piston flowmeter, but it is not epicyclic, and uses rollers and cams moved by its pistons, to produce uniform shaft rotation proportional to volumetric displacement in the chambers. There is no rotation of the cylinders. Smith U.S. Pat. No. 2,661,699 is a crossed-piston engine with a conventional crank, stationary cylinders and sliding ("Scotch") yokes connecting the pistons to the connecting rods, similar to Guinard's device. The Smith engine is not epicyclic. Johnson U.S. Pat. No. 2,684,038 is another crossed piston design with scotch yokes, but with yokes in the connecting rods' centers, rather than at the pistons as in Smith. DeLancey, Smith, and Johnson are all cited by Richards. In addition, none of these patents describe a combination of pressure chambers and vacuum chambers in a single device. Moreover, the existing patents all describe oil-lubricated devices and do not describe a concentrator system in oil-free form.

The more relevant patents citing Richards include Baker U.S. Pat. No. 3,977,303. Baker is epicyclic, but includes a free-rotating secondary eccentric between his crankshaft and pistons, all within a non-rotating cylinder block. Gail U.S. Pat. No. 5,375,564 teaches an oil-lubricated epicyclic engine with three or more piston axes (and cites Avermaete U.S. Pat. No. 3,665,811, another 3-cylinder epicyclic engine; Lamm U.S. Pat. No. 3,799,035 which teaches a spinning epicyclic engine or pump similar to the present invention; and Froumajou U.S. Pat. No. 3,921,602 which describes an engine of complex epicyclic form in which the pistons describe multiple strokes per revolution, where eccentricities of the rotating elements have non-unity integer ratio). Farrington U.S. Pat. No. 6,148,775 discloses an engine with the epicyclic kinematics of the present invention.

What is needed is a compact, balanced, and low-cost oil-free pump that can serve either simple PSA, the more efficient and compact VPSA systems or both PSA and VPSA. Compactness and balance are of special value to portable concentrators, and low cost is of greater value in stationary units.

SUMMARY

A rotary, positive displacement pump (also referred to as a spin pump) is described that in an embodiment includes a combination of a compressor and a vacuum pump on respective pistons extending from a common crankshaft in a rotating housing of the spin pump. The spin pump is advantageously compact, light in weight, inexpensive, portable, and produces no or minimal vibration due to a near perfectly balanced construction.

The details of one or more variations of the subject matter described herein are set forth in the accompanying drawings and the description below. Other features and advantages of the subject matter described herein will be apparent from the description, the drawings, and the claims.

DESCRIPTION OF DRAWINGS

Like reference symbols in the various drawings indicate like elements.

DETAILED DESCRIPTION

Figure 1:
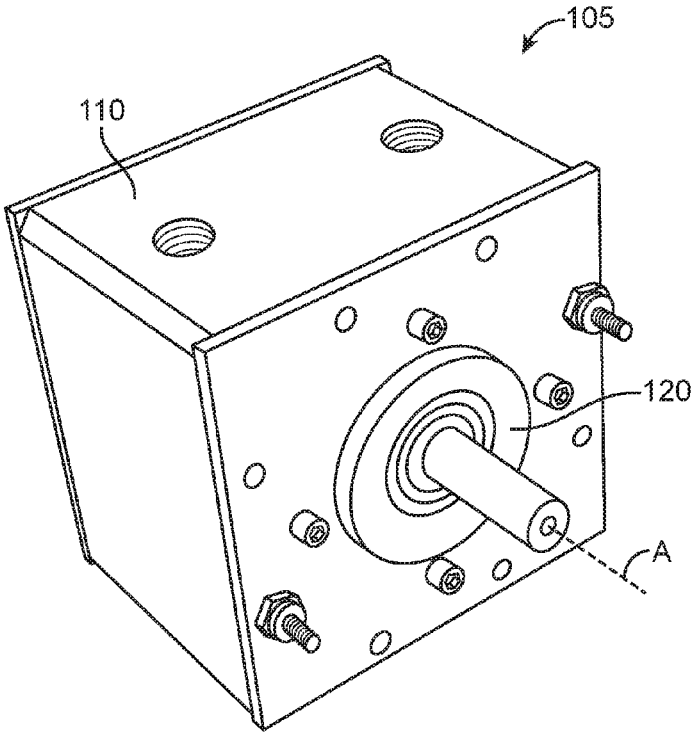
FIG. 1 shows a perspective view of a spin pump assembly.

Disclosed is a low-cost, easy to machine rotary or spin pump assembly for use in an oxygen concentrator. In an embodiment, the spin pump assembly operates as a compressor pump pursuant to a PSA cycle. In another embodiment, the spin pump assembly operates as a vacuum pump pursuant to a VPSA cycle. In an optional embodiment, the spin pump assembly combines both a compressor pump (PSA) and a vacuum pump (VPSA). The ease of machining is due to requiring only flat and circular surfaces on the components of the pump. In an embodiment, the components of the pump include operative part surfaces comprising portions of the pump components that define piston or fluid chambers or portions that abut adjacent portions either in a fixed or moving relationship. Some non-limiting examples of operative part surfaces include the internal walls of piston chambers, as well as the outer surface of the rotor that spins adjacent to a housing surface and surfaces of bearings. The operative part surfaces are those requiring precision for function, and here all such surfaces can all be substantially flat or cylindrical and/or machined at low cost. No special profiles such as those required in making other forms of pumps (e.g., a swing or scroll compressor) are required.

As described in detail below, the spin pump assembly employs an epicyclic geometry, which uses a counter-rotating vectors approach to generating straight-line reciprocation for pistons in the cylinders of the pump. Moreover, a reference frame for the counter-rotating vectors is itself spinning. That is, both vectors can spin clockwise—but one vector can spins at 2× speed of the other vector. This contrasts with a normal epicyclic, where a bearing part is stationary (i.e., spin speed zero) and two-counter-rotating parts spin at opposite spin speeds (say, of −1 and 1). They combine to produce straight-line reciprocation, which can let a piston move relative to a stationary cylinder. In the system described herein, all parts receive additional forward spin relative to the surrounding 'ground', so a cylinder-bearing part (i.e., the rotor) changes from spin speed zero to 1, one previous rotator goes from −1 to zero and becomes the new 'grounded' part instead of the cylinders, and other rotator—the crankshaft—goes from speed 1 to 2.

The spin pump assembly includes an offset between a crank axis and a rotor axis of the assembly. A crankpin represents or defines one vector and a center of the rotor location relative to the crank axis represents another vector.

The rotor includes a first piston that is driven by the crank pin and trapped in the rotor's transverse cylinder. The first piston is driven to reciprocate in the rotor as the rotor rotates at half crank speed. In order to greatly reduce or remove side load from the pistons, an internal-external timing gear (such as a 2:1 timing gear) can be disposed on the outside ends of the crankshaft and can be fitted to move the rotor and crank together. The rotor also includes a second piston in the same rotor. The second piston is optionally axially offset relative to the first piston, with its reciprocation axis 90 degrees to the first (and the matching crankpin 180 degrees out). In another embodiment, fork-and blade rods are used, or rods offset from piston centerlines, so piston centerlines fit all in one plane even when bearings are offset along the crankshaft axis.

In an embodiment, porting of the pistons is independent such that one piston serves as a vacuum pump and the other piston serves as pressure pump.

Figure 2:
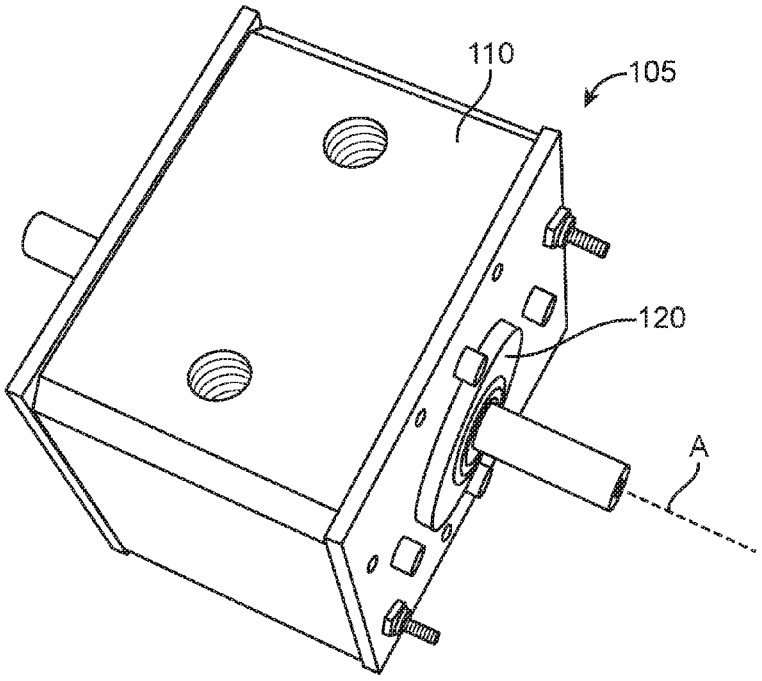
FIG. 2 shows another perspective view of the spin pump assembly.

There are now described some example embodiments of the spin pump assembly for use in an oxygen concentrator. FIGS. 1 and 2 show perspective views of a spin pump assembly 105, which includes a housing 110, such as an outer housing, that contains a rotor 205 (shown in FIGS. 3 and 4) that is rotatably mounted inside the housing 110. The rotor 205 is driven to rotate by a crankshaft 115 that defines a first axis A. The crankshaft 115 is rotatably coupled to the housing 110 such as, for example, via one or more bearing plates 120. The rotor 205 contains a pair of cylindrical bores (FIGS. 3 and 4), each of which contains at least one piston such that the piston(s) define at least one fluid chamber inside each of the bores. The bore(s) may be radial or diametral relative to a center axis of the rotor 205. That is, the bore(s) may extend partially through the rotor or may extend entirely through the rotor such that the bore(s) intersect and form openings through two sides of the rotor. The kinematics of the spin pump assembly are described in detail below. The rotor is contained in a close fit alignment within the housing. For example, there may be a radial gap between the rotor and the housing of 0.001-0.002 inch.

In the embodiment of FIGS. 1 and 2, the housing 110 has an outer shape that is rectangular with substantially flat surfaces, which provide ease of manufacturing. A full housing may not be required if the piston cylinders are fitted with heads that rotate with them. The housing 110 has a cylindrical bore in which the rotor 205 is rotatably positioned. As discussed in more detail below, the rotor 205 rotates about a second axis of rotation that is parallel to, but offset from, the first axis of rotation defined by the crankshaft 115. In an embodiment, the second axis is offset from first axis by ¼ of the desired stroke and crankpin eccentrics are offset from crank rotation axis by ¼ of desired stroke.

Figure 4:
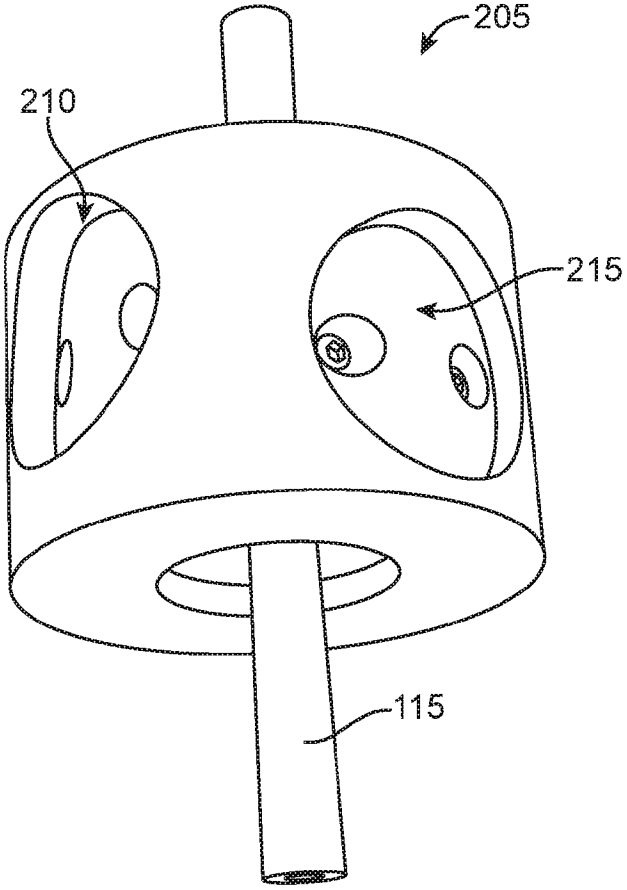
FIG. 4 shows another perspective view of a rotor of the spin pump assembly.
Figure 3:
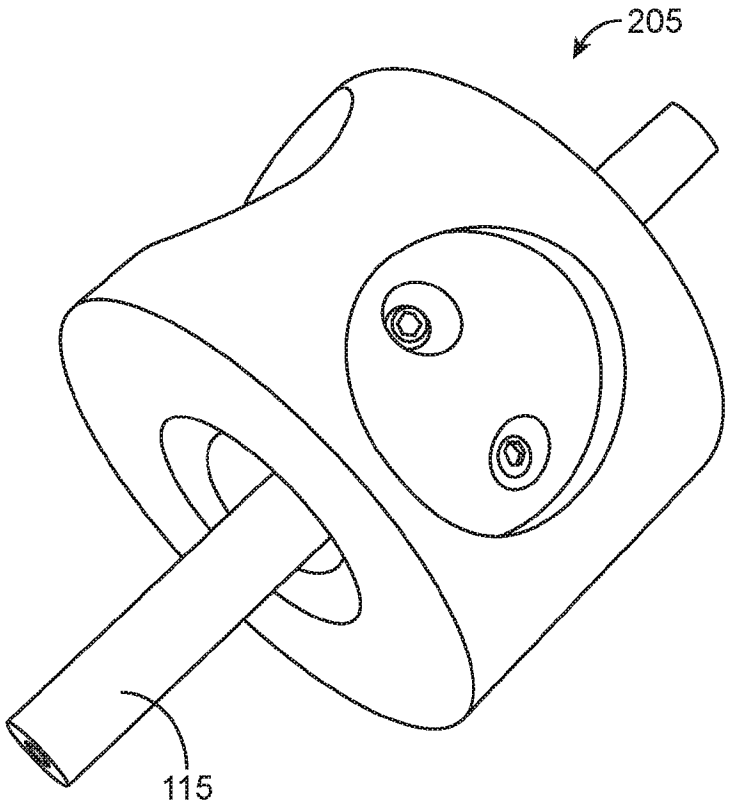
FIG. 3 shows a perspective view of a rotor of the spin pump assembly.
Figure 5:
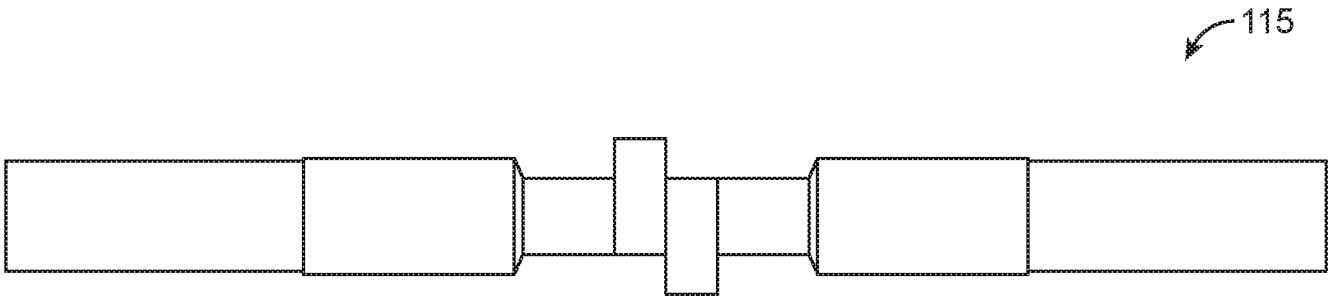
FIG. 5 shows a crankshaft of the spin pump assembly.

FIGS. 3 and 4 show perspective views of the rotor 205, which surrounds the crankshaft 115. The crankshaft carries pistons that ride in the rotor, but there is no direct attachment between the rotor and the crankshaft. Rotation of the rotor occurs because of the pistons pushing on their cylinder walls when the crankshaft rotates (unless a timing gear directly drives the rotor from the crank. The rotor 205 includes two cylindrical piston chambers 210 and 215, each of which contains at least one piston. In an embodiment, the piston chambers are offset by 90 degrees relative to one another. In an embodiment, both of the piston chambers serve as a compression chamber (for example, for use in a PSA cycle). In another embodiment, both of the piston chambers serve as a vacuum pump chamber. In another embodiment, one piston chamber serves as a compression chamber and another piston chamber serves as a compression chamber (for example, for use in a VPSA cycle). FIG. 5 shows the crankshaft 115 in a standalone state.

Figure 6:
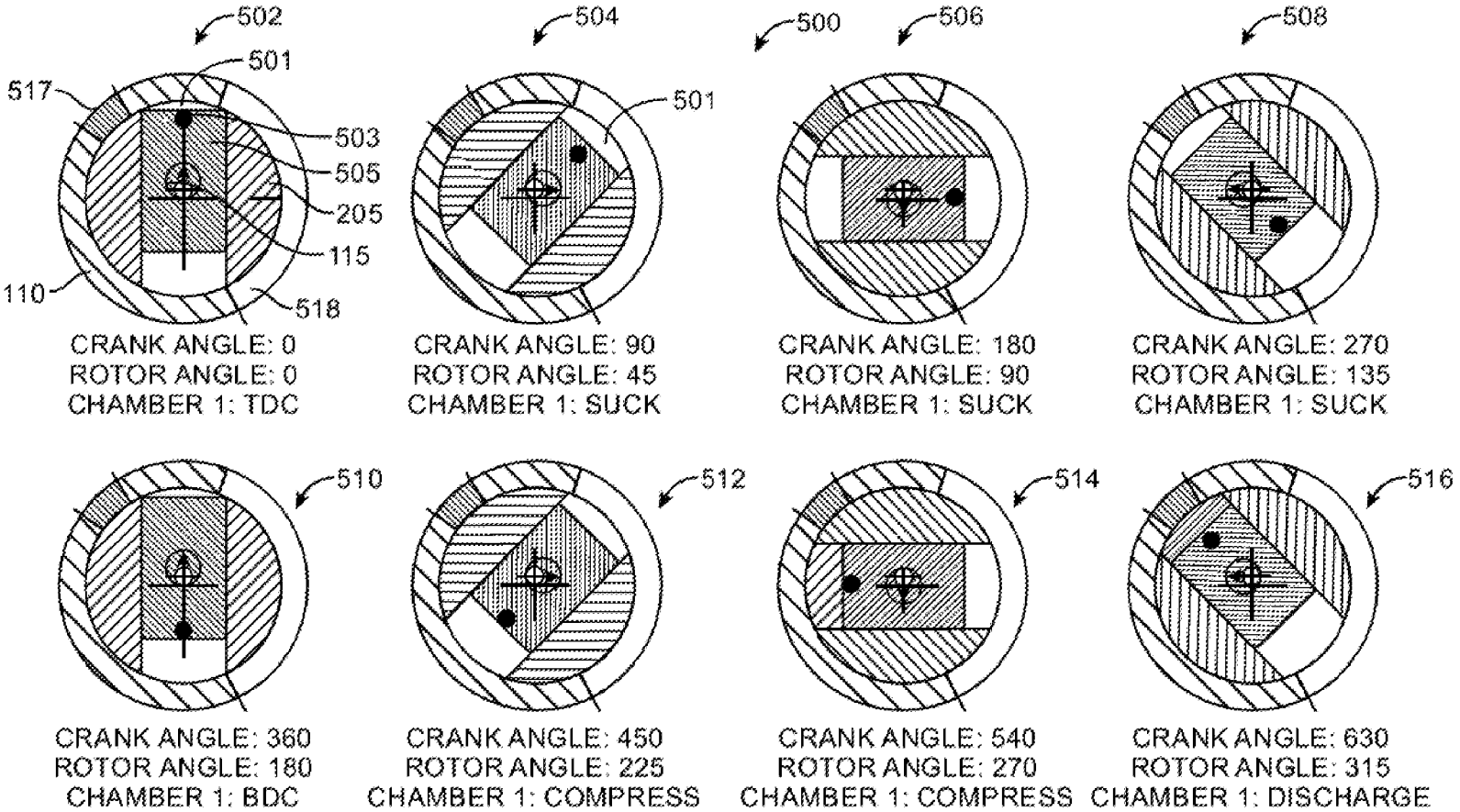
FIG. 6 shows a diagram illustrating kinematics of the spin pump assembly.

FIG. 6 is a schematic diagram 500 illustrating kinematics of the spin pump assembly 105. The schematic diagram shows an example piston 505 movably mounted in the rotor 205, which is rotatably positioned in the housing 110. The crankshaft 115 drives the piston 505 to rotate and thereby to reciprocate within the rotor 205, itself rotating in housing 110, which includes a discharge port 517 and a suction port 518. The piston may have any of a variety of structures. In an embodiment, the piston is formed of a pair of piston crowns on a connecting rod.

Diagram 500 of FIG. 5 schematically shows a sequence of steps in the operation and rotation of the components in the spin pump, proceeding from an arbitrary first position shown at upper left at position 502, and sequentially from position 502 to position 516. After a further equal increment subsequent to 516, the sequence again goes to the first position shown at position 502.

As mentioned, the components of the spin pump assembly are arranged in a spun-epicyclic geometry, which allows a counter-rotating vectors approach for generating a straight-line reciprocating motion of the pistons 505 with respect to the rotor 205. The center of rotation of the rotor 205 is concentric to the bore of housing 110, which can be stationary. The center of rotation of the crankshaft 115 is parallel to but offset from the rotor center by a predetermined distance, such as a distance equal to one quarter of the desired piston stroke (as shown initially upward by diagram 500 at crank angle zero, at 502). The crankshaft has a crankpin offset from the center of rotation of the crankshaft 115 by one quarter of the desired piston stroke (also shown upward at 502).

At position 502: when a torque is applied to the crankshaft 115 by an external device (for example, a motor, which is not shown) at the position 502, a lateral force is generated on the piston 505 at its mid-length where the crankpin fits. This force presses the piston 505 against the cylinder wall that contains it in rotor 205. However, because of the combined offset of the crank rotation center and the crankpin (which combine to hold one piston end marked here with a dot 503 at a maximum proximity to the outer rim of the rotor), this force is applied to the rotor 205 away (for example, by a distance of two quarters or one half of the piston stroke) from its own center of rotation. This force causes a torque on the rotor 205 around its own rotation center. The torque compels the rotor 205 to spin on its bearings about the center of the rotor 205.

At 504: the rotor 205 has turned 45 degrees clockwise, and the crank has rotated 90 degrees, maintaining the relative alignment of the crankpin, the piston, and rotor bore. Accordingly, the piston 505 (refer to the shown dot end 503) has retreated axially relative to the outer rim of the rotor 205, thus beginning the suction stroke of the dot-end chamber in the spin pump assembly 105 (the chamber at opposite end of piston 505 simultaneously experiences compression). The space between the dot end 503 of the piston 505 and the rim of the rotor 205 is exposed to the suction port of the housing from times between position 502 and position 510.

With further rotation of the crankshaft 115, parts continue to spin on their centers. As the crankshaft 115 spins around its axis, the piston 505 orbits around the center of the crankshaft 115, as shown from 502 to 516. The offsets between the center of the rotor 205 and the center of the crankshaft 115 move from an alignment position (where those offsets are additive, as shown in 502 and 510) to anti-alignment position (where those offsets are cancelling, as shown in 506 and 514). However, with respect to the rotor 205 (which is also rotating), the vector sum of the crank center eccentricity and the crankpin eccentricity remains aligned with the axis of the cylinder in rotor 205 and thereby the motion of the piston 505 in that cylinder. From the frame of reference of the rotor 205, the first eccentricity (that is, a fixed-magnitude vector about the rotor center, and directed toward the crank center fixed in the housing) moves counter-clockwise, equal, and opposite to a vector associated with the second eccentricity (that is, a fixed-magnitude vector about the crank center, and directed toward the crank pin). During the addition of these vectors, the opposite component parts of the vectors cancel while the component parts of the complementary components of those vectors sum up, thereby resulting in a linear reciprocating vector of sinusoidal magnitude. This linear reciprocating vector with sinusoidal magnitude characterizes the stroke of the piston 505 relative to the rotor 205. This movement of the piston is also referred to as an epicyclic movement.

By adding a spin to such a system in its entirety, the relative rotations of housing (crank eccentricity), rotor 205, and crankshaft 115 (crankpin eccentricity) are changed from being negative, zero, and positive with respect to ground to being zero, positive, and twice positive, as shown in diagram 500. The crankshaft 115 rotates at twice the rate of the rotor 205 and the housing is stationary, but their relative movements are the same as if the rotor 205 were stationary, the housing rotated opposite to the crankshaft, and the piston 505 reciprocated in the rotor 205.

As mentioned, an internal-external 2:1 timing gear may be connected to the crankshaft 115 and the rotor 505 to enforce their relative rotational speeds without delivering power through the piston-rotor contact surface (the rotor cylinder bore). The internal-external 2:1 timing gear moves the crankshaft 115 together with the rotor 205 such that the rotation of the crankshaft 115 is twice the rotation of the rotations of the rotor 205 and the piston. While such rotations occur, the housing stays static in a same position, as shown in FIG. 6.

However, in some implementations (based on some empirical testing), the spin pump assembly 105 may not require such timing gears when both the crankshaft and rotor are independently supported on bearings with respect to the housing (or, equivalently, to 'ground'). In these implementations, timing gears may be deleterious to the simplicity and efficiency of the spin pump assembly 105. The inertia of the rotor 205 may be made sufficient to carry the motion smoothly through positions where the crankshaft torque exerts no net torque on the rotor to encourage its further rotation (for example, through positions 506 and 514). However, addition of a second piston that is oriented at ninety degrees to the piston 505 and that is driven by a second crankpin oriented 180 degrees from the crankpin may be used to eliminate such zero-torque positions when both pistons share a common rotor 205 and crankshaft 115.

As a further explanation of the above-noted operation associated with the epicyclic movement, consider the effect of the fluid chamber 501 as the piston 505 rotates through one cycle from 502 to 516. At 502, the crankshaft 115 is at an angle of zero, the rotor 205 is at an angle of zero, and the chamber 501 is at the top dead center (TDC). The TDC characterizes a datum position where the face of the piston is in a same angular position as the angular position of the crankshaft 115. At the TDC, the volume of the chamber 501 is minimum. As the piston rotates clockwise to go towards 504, the cylinder opens to the suction port and the volume of the chamber 501 expands.

At 504, the crankshaft 115 has already rotated ninety degrees while the rotor 205 and the piston have already rotated forty-five degrees. As noted above, the suction occurs here, and the volume of the chamber 501 keeps expanding until the suction ends.

At 506, the crankshaft 115 has already rotated one hundred and eighty degrees while the rotor 205 and the piston have already rotated ninety degrees. Suction continues, and the volume of the chamber 501 keeps expanding.

At 508, the crankshaft 115 has already rotated two hundred and seventy degrees while the rotor 205 and the piston have already rotated one hundred and thirty five degrees. The volume of the chamber 501 keeps expanding until the suction ends. As the face of the piston moves towards the position illustrated at 510, the expansion of the volume of the chamber reaches a maximum and stops after suction ends and the chamber becomes sealed from the suction port 518.

At 510, the crankshaft 115 has already rotated three hundred and sixty degrees while the rotor 205 and the piston have already rotated one hundred and eighty degrees. The chamber 501 is at the bottom dead center (BDC). At 510, the suction has stopped (as the chamber 501 has become sealed from suction port), and the discharge has not yet begun.

At 512, the crankshaft 115 has already rotated four hundred and fifty degrees while the rotor 205 and the piston have already rotated two hundred and twenty five degrees. There is neither suction nor discharge from volume of the chamber 501. Accordingly, the volume of the chamber 501 has decreased without substantial change in the mass of contained fluid, and pressure has risen therein.

At 514, the crankshaft 115 has already rotated five hundred and forty degrees while the rotor 205 and the piston have already rotated two hundred and seventy degrees. There is neither suction nor discharge from volume of the chamber 501. Accordingly, the volume of the chamber 501 has further decreased and the pressure of the fluid contained in the chamber 501 has further risen until (just after this 514 moment) the chamber 501 reaches the discharge port and the discharge begins. The exact timing of such opening is preferably determined by positioning the discharge port such that the pressure rise achieved in chamber 501 matches the desired discharge pressure at the port.

At 516, the crankshaft 115 has already rotated six hundred and thirty degrees while the rotor 205 and the piston have already rotated three hundred and fifteen degrees. There is discharge from volume of the chamber 501. Accordingly, the volume of the chamber 501 continues to decrease as the rotor 205 moves toward its initial TDC position again, even as the chamber 501 remains open to discharge port and fluid is pressed out of chamber 501, as seen at 516.

Finally, for this one complete cycle, at 502 again the crankshaft has rotated seven hundred and twenty degrees while the rotor 205 and piston have rotated three hundred sixty degrees to return to the original condition, at TDC, with substantially all of the inducted fluid (from the suction port) having been compressed and delivered out of the discharge port, from which chamber 501 has already been sealed by passing beyond it, and approaching again the suction port to begin a new cycle.

In some implementations, a one-way valve can be included at either suction or discharge ports to reduce or substantially eliminate back flow or cross flow between ports. Such a one-way valve can be provided on the piston in place of the suction or discharge port. The crankshaft area of the housing communicating with chamber 501 through the valve can be used as a source or sink of the pumped fluid, respectively. The bore of rotor 205 can be capped by valves or ducts adjacent to the bore within the rotor 205. Conduction and direct flow in and out of the chamber 501 may not use ports in the housing addressing the periphery of the rotor 205, but rather may occur through crankshaft area or axial end faces of rotor to external ports there.

Based on such kinematics and the selection of compatible dry-lubricating materials for piston and rotor, the need for oil in the spin pump assembly 105 as a lubricant is advantageously obviated. Materials for the assembly may include, for example: polymers selected from PTFE, polyethylene, acetal, or other known low-friction materials for one part (for example, the piston or a coating thereon); anodized aluminum, nickel plating, vapor-deposited diamond graphite or other known hard, smooth surfaces (e.g. for the rotor bore).

As there is no oil lubrication, the spin pump assembly 105 can provide breathable quantity of compressed gas, such as oxygen. Additionally, the rotational movements associated with the above-noted kinematics advantageously prevent vibration that is caused in conventional pumps due to linear or oscillatory movements of their moving parts with respect to ground, because each component part in the present invention is either spinning about its own center or orbiting around another spin center. So, rotating balancing masses can be applied for substantially perfect elimination of forces and vibration from unbalanced mass in motion.

Further, the components used in the spin pump assembly 105 are light in weight (for example, between 0.2 kilograms and 0.5 kilograms for a two-piston unit with swept volume of 20 cc/rotor revolution, as shown with respect to the spin pump assembly 105.). In other implementations, the weight of the components can be based on the scale of the device. For example, the components can weigh a few micrograms or a few kilograms. Light weight and pure rotational motion combine to enable high operating speeds, further reducing the required size and mass for a desired output flow.

The spin pump assembly 105 is inexpensive to manufacture because all key part shapes or features are simple cylinders or planes and all relative orientations of shapes or features are parallel or orthogonal. Additionally, the spin pump assembly 105 is inexpensive as compared to many conventional pumps. Further, the spin pump assembly 105 is small, portable, and affordable. Further, the spin pump assembly 105 can operate in concentrators based on the principle of vacuum pressure swing adsorption (VPSA), where lower pressure portions of the kinematics cycle are sub-atmospheric, because the adsorbent substances can deliver more oxygen per unit mass of the adsorbent substance when pressures are at the vacuum levels. This is most advantageously achieved by dedicating one piston (two faces) to pressure, and another piston (two other faces) to vacuum, with those pistons operating axially separated and with axes ninety degrees apart on a crankshaft 115 with crankpins one hundred eighty degrees apart, and with each piston addressing separate suction and discharge ports connected to their respective cycle control valves. Alternatively, two rotors with one piston each can be driven by a single crankshaft, but with an intervening partition to isolate the vacuum pump rotor from the pressure rotor.

Figure 7:
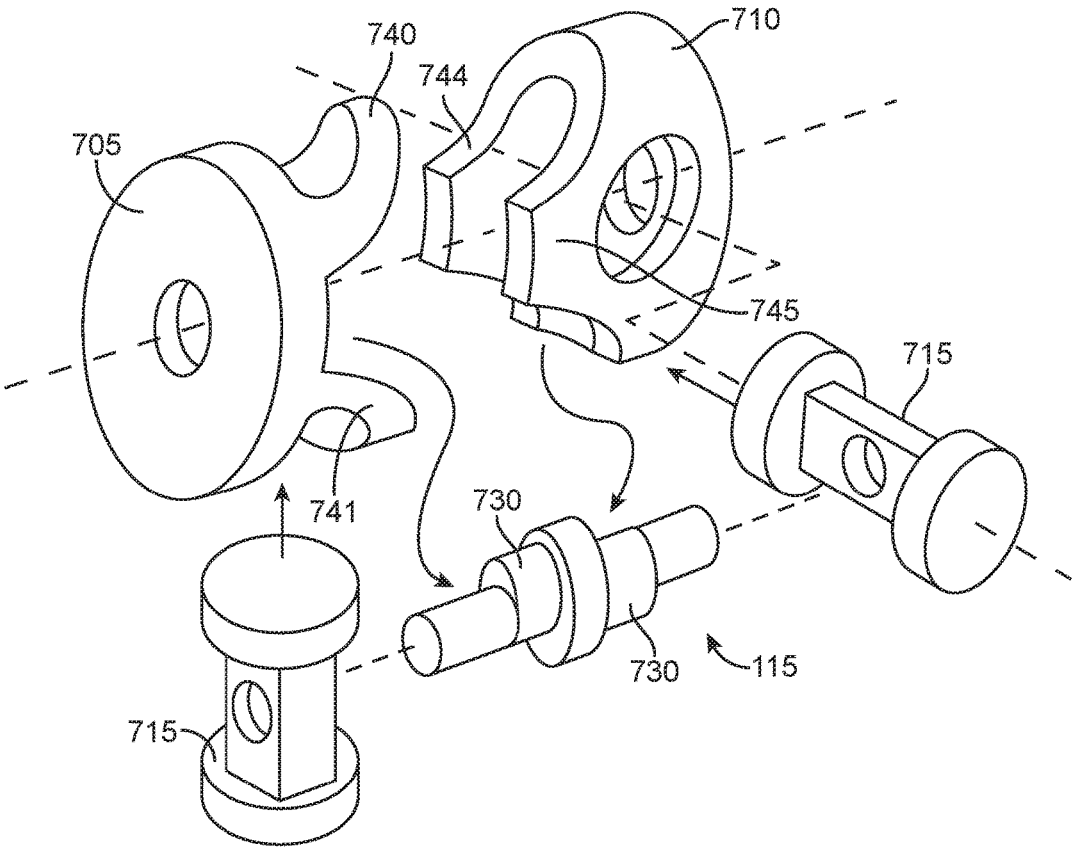
FIG. 7 shows an alternate embodiment of the spin pump assembly in an exploded state.
Figure 9:
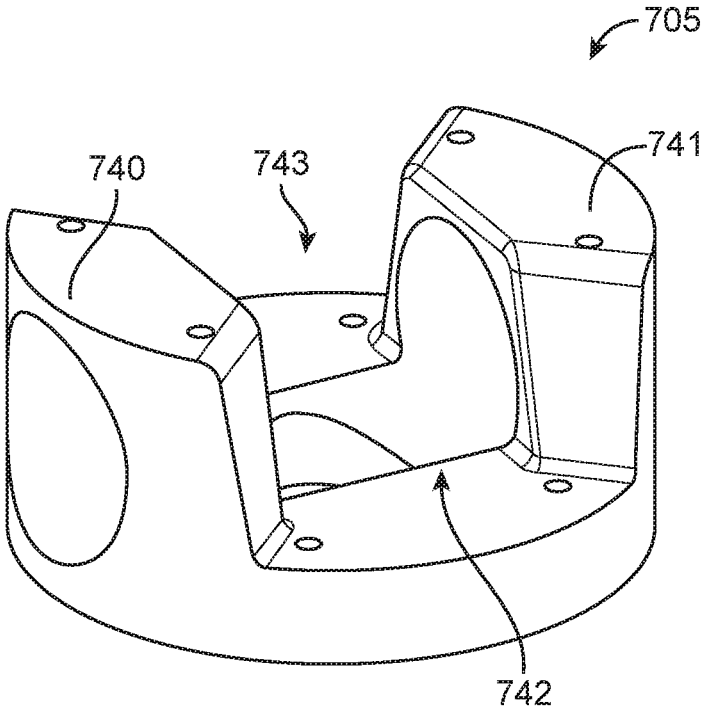
FIG. 9 shows a first congruent piece of a two part rotor.

FIG. 7 shows another embodiment of the rotor assembly wherein the rotor is formed of a first piece 705 and a second piece 710 (i.e., a pair of congruent halves) that mate with one another to collectively form the rotor, wherein the first piece includes a first tongue 740 and a second tongue 741 that define a first space 742 (FIG. 9) and a second space 743 (FIG. 9) between the first tongue and the second tongue, and wherein the second piece includes a third tongue 744 and a fourth tongue 745. The rotor may be cylindrical as shown or it may be rectangular or any other shape. The two pieces also collectively form the two piston chambers when mated to one another wherein each piece forms the entirety of a single piston's bore(s) such that each piece can contain a piston without having to be mated to the other piece. Each of the two pieces 705 and 710 individually form a cylindrical portion of two coaxial piston chambers aligned perpendicular to the rotation axis of the respective piece. When the two pieces are engaged or mated to one another, the rotational axis of one piece co-axially aligns with the rotational axis of the other piece to form the rotor.

By splitting the rotor into two congruent halves that interlockingly engage one another, full cylinders are formed in each half (or each piece) for each double-ended piston. This enables single-piece, double-ended pistons 715 to be inserted into the cylinders (i.e., piston bores) before the two pieces of the rotor are assembled over the two ends of the crankshaft 115. With the single-piece rotor, only one piston can be inserted into the cylinders before they are assembled over the two ends of the crankshaft, hence at least one multi-piece piston is required in one-piece rotor approach. With a hub-and-caps rotor (see for example, Richards 2,683,422), alignment of cylinder axes across the hub and rotation axis of the rotor is difficult and effectively precludes oil-free operation that requires greater precision to minimize incident lateral loads on pistons and cylinders.

Figure 8:
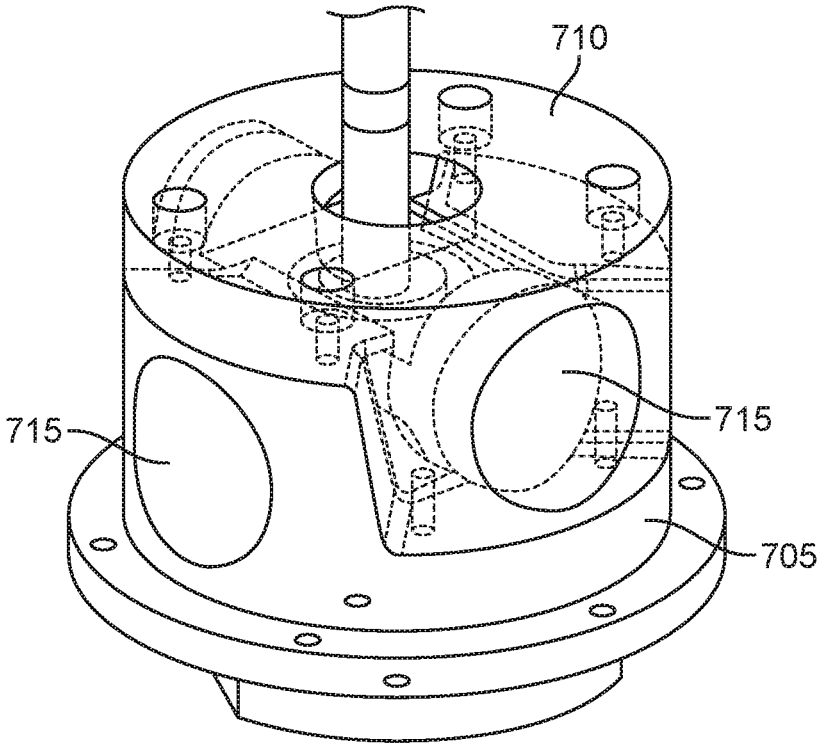
FIG. 8 shows an example of a two-piece rotor in an assembled state.

FIG. 8 shows an example of a two-piece rotor in an assembled state. The two congruent or substantially congruent pieces 705 and 710 are mated to one another so as to collectively form the rotor. The piece 710 is shown in phantom to illustrate internal components of the rotor. Note that each piece 705 and 710 includes an entire cylindrical piston bore that fits a single piston. The single piece pistons 715 are each positioned in a respective piston bore in each piece, with the rotor comprising all bores being collectively formed by the first and second pieces when assembled together.

In a method of assembly, the pair of single piece, double ended pistons are positioned or otherwise inserted into the respective piston bores of the first and second, generally congruent pieces of the rotor. In this manner, there are two rotor pieces with each rotor piece containing a piston in its respective piston bore. The first piston-filled piece is then assembled over one end of the crankshaft, by aligning and fitting the piston (at its central cross-bore, where a bearing may be located) onto an eccentric 730 (FIG. 7) of the crankshaft. The second piston-filled piece is then assembled over the other, opposite end of the crankshaft, by aligning and fitting the piston (at its central cross-bore, where a bearing may be located) onto another eccentric 730 of the crankshaft. The second piece of the rotor thereby becomes mated or engaged with the first piece of the rotor and can be joined by bolts or other known fastener means, so that the pistons are seated within the piston bores and such that the first and second pieces collectively form the piston bores and the rotor.

Figure 10:
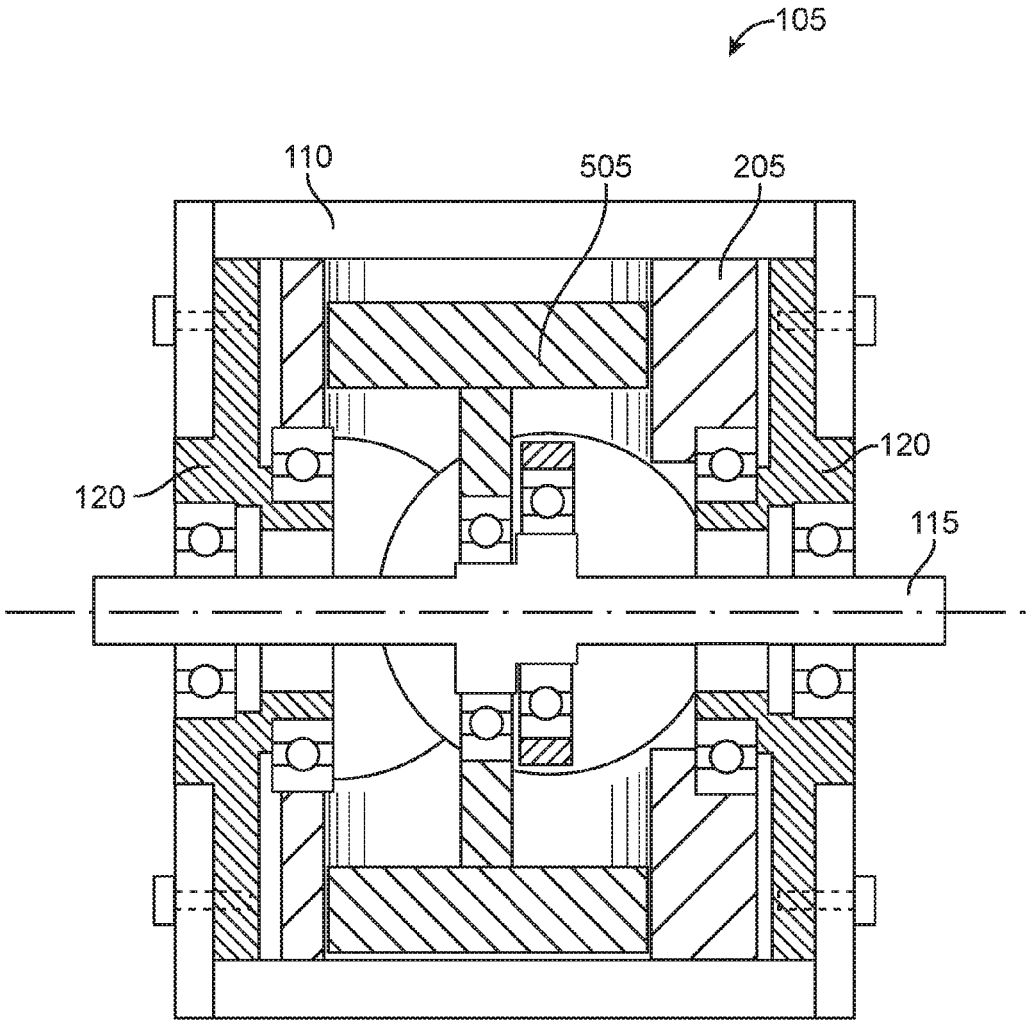
FIGS. 10 and 11 show cross-sectional views of embodiments of the spin pump assembly in assembled states.
Figure 11:
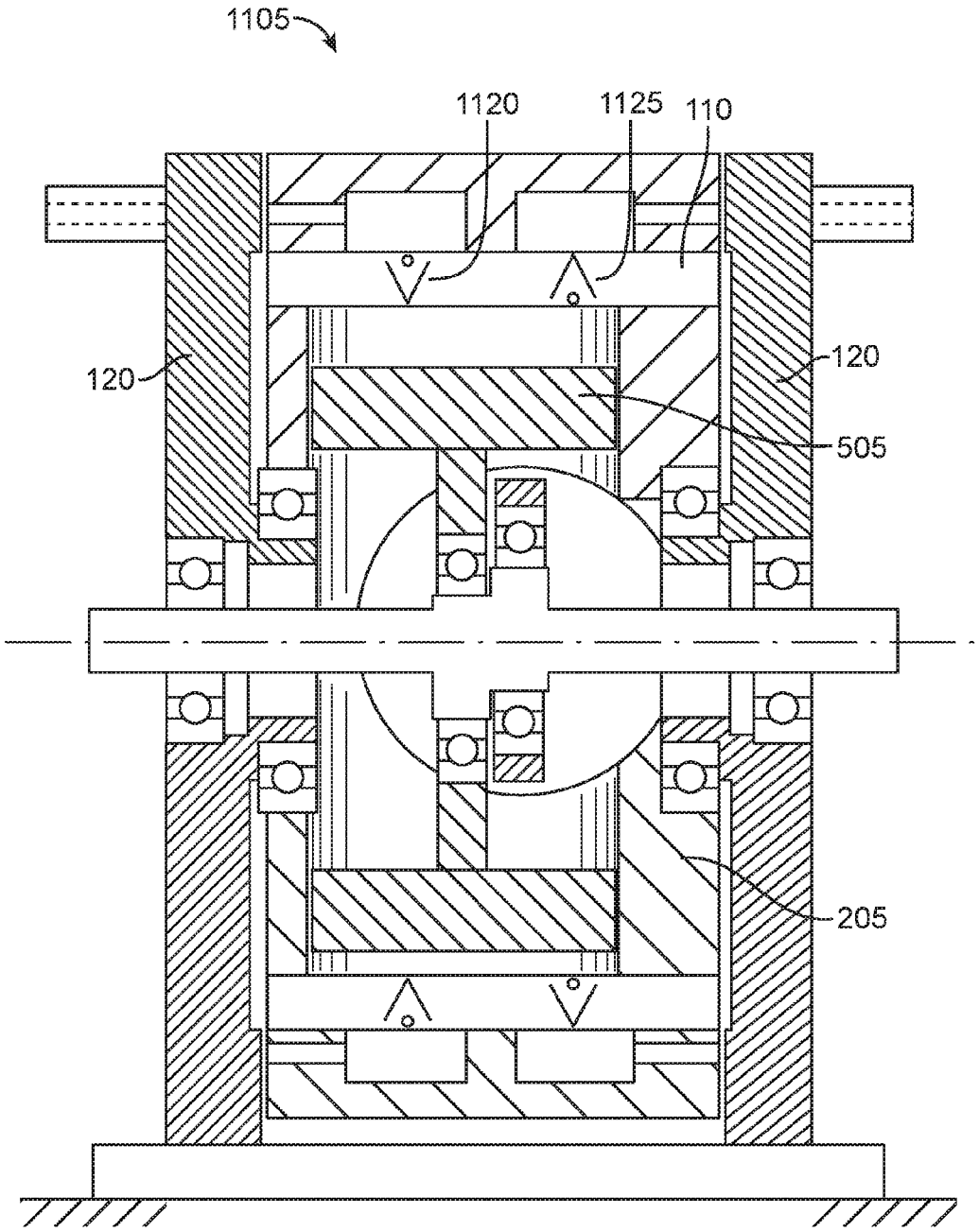

FIG. 10 shows a cross-sectional view of the spin pump assembly 105 in an assembled state. The rotor 205 is mounted over the crankshaft 115 with a piston 505 movably positioned in a piston bore and coupled to the crankshaft 115 and enclosed by housing 110 and bearing plates 120. In another embodiment shown in FIG. 11, the piston bore ends in rotor 205 are coupled to heads 1105. Valve plates may include valves 1120 and 1125 that regulate fluid inflow and fluid outflow routed to respective side ports in bearing plates 120. Thus, at least one valve is coupled to one of the piston bores. In an embodiment, one of the valves is a outlet valve on a piston head and another valve is an inlet valve on a piston, whereby inflow may be drawn through the central crankcase portion of the pump and outflow discharged through the head.

The embodiments shown in the figures are examples and it should be appreciated that changes are possible and within the scope of this disclosure. For example, in an embodiment the pistons are rectangular or non-cylindrical and are mounted in complementary-shaped bores. In another embodiment, the rotor is rectangular or non-cylindrical. Other variations are within the scope of this disclosure.

Although a few variations have been described in detail above, other modifications can be possible. For example, the logic flows depicted in the accompanying figures and described herein do not require the particular order shown, or sequential order, to achieve desirable results. Other embodiments may be within the scope of the following claims.

The invention claimed is:

1. A pump system with a compressor pump and a vacuum pump on a common shaft, comprising: a rotor that rotates about a first axis, the rotor having a first and a second radial piston bore each sized to contain at least one piston, wherein the first radial piston bore can serve as a vacuum pump and the second radial piston bore can serve as a compressor pump, said first and second radial piston bores being capped with caps including ducts or valves that are adjacent to the first and second radial piston bores within the rotor; a crankshaft defining a second axis parallel to and offset from the first axis, wherein the crankshaft rotates about the second axis and drives rotation of the rotor; wherein a first piece and a second piece mate to collectively form the rotor, wherein the first piece includes a first tongue and a second tongue that define a first space and a second space between the first tongue and the second tongue, and wherein the second piece includes a third tongue and a fourth tongue, and wherein the third tongue and the fourth tongue are positioned within the first space and the second space when the first piece and second piece are mated together; wherein the first radial piston bore extends at least partially through the first tongue and the second tongue, and the second radial piston bore extends at least partially through the third tongue and the fourth tongue.

2. A pump system as in claim 1, wherein each of the first and second pieces of the rotor forms a cylindrical portion of one of the first or second radial piston bores.

3. A pump system as in claim 1, wherein the first and second pieces are congruent.

4. A pump system as in claim 1, wherein the first piece of the rotor includes an entirety of the first piston bore that contains a piston and the second piece of the rotor includes an entirety of the second piston bore that contains a second piston.

5. A pump system as in claim 1, wherein there is a radial gap between the rotor and the housing of 0.0005-0.003 inch.

6. A pump system as in claim 1, wherein the first and second pistons comprise solid lubricant at interfaces between the piston and the rotor.

7. A pump system as in claim 1, wherein the pump includes two or more operative part surfaces, and wherein all operative part surfaces of the pump at least one of flat and cylindrical.

8. A pump system as in claim 7, wherein the operative part surfaces are parallel or orthogonal to one another.

9. A pump system as in claim 1, further comprising a housing containing the rotor, wherein the housing includes one or more ports that communicate with the piston bores.

10. A pump system as in claim 9, wherein the ports eliminate a need for valves.

11. A pump system as in claim 9, wherein the ports are axially offset from one another to avoid cross-connection between fluid flow of the compressor pump and the vacuum pump.

12. An oxygen concentrator comprising the pump system as defined by claim 1.

13. An oxygen concentrator as in claim 12, wherein the oxygen concentrator is portable.

14. An oxygen concentrator as in claim 12, wherein the pump is kinematically balanced.

15. A pump system as in claim 1, further comprising at least one valve coupled to one of the piston bores.

16. A pump system as in claim 15, wherein the valve is mounted on a piston head of the at least one piston.

17. A pump system as in claim 1, wherein the first radial piston bore of the rotor contains a first single-piece, double-ended piston and the second radial piston bore of the rotor contains a second single-piece, double-ended piston.

* * * * *